US010394261B2

(12) United States Patent
Stanzione

(10) Patent No.: US 10,394,261 B2
(45) Date of Patent: Aug. 27, 2019

(54) VOLTAGE REFERENCE GENERATOR AND A METHOD FOR CONTROLLING A MAGNITUDE OF A VARIATION OF AN OUTPUT VOLTAGE OF A VOLTAGE REFERENCE GENERATOR

(71) Applicant: Stichting IMEC Nederland, AE Eindhoven (NL)

(72) Inventor: Stefano Stanzione, Leuven (BE)

(73) Assignee: STICHTING IMEC NEDERLAND, Ae Eindhoven (NL)

( * ) Notice: Subject to any disclaimer, the term of this patent is extended or adjusted under 35 U.S.C. 154(b) by 0 days.

(21) Appl. No.: 15/890,336

(22) Filed: Feb. 6, 2018

(65) Prior Publication Data

US 2018/0231997 A1 Aug. 16, 2018

(30) Foreign Application Priority Data

Feb. 10, 2017 (EP) ..... 17155631

(51) Int. Cl.
*G05F 1/46* (2006.01)
*G05F 3/08* (2006.01)
*G05F 1/59* (2006.01)

(52) U.S. Cl.
CPC ..... *G05F 1/468* (2013.01); *G05F 1/59* (2013.01); *G05F 3/08* (2013.01)

(58) Field of Classification Search
CPC ..... G05F 1/468; G05F 1/59; G05F 3/08
USPC ..... 327/539, 551–559
See application file for complete search history.

(56) References Cited

U.S. PATENT DOCUMENTS 6,713,996 B2 3/2004 Di Iorio
7,567,063 B1 7/2009 Suzuki et al.
8,754,699 B2 * 6/2014 Bawa ..... H03H 19/004 327/337

(Continued)

FOREIGN PATENT DOCUMENTS

DE 10223996 A1 12/2003

OTHER PUBLICATIONS

Lee et al., "A Regulated Charge Pump With Small Ripple Voltage and Fast Start-Up", IEEE Journal of Solid-State Circuits, vol. 41, Issue 2, pp. 425-432, Feb. 2006.

(Continued)

*Primary Examiner* — Dinh T Le
(74) *Attorney, Agent, or Firm* — Moser Taboada

(57) ABSTRACT

A voltage reference generator comprises a voltage reference, a variable gain amplifier connected to an output terminal of the voltage reference, a sampling capacitor connected to an output terminal of the voltage reference generator and to an output terminal of the variable gain amplifier via a sampling switch. The switch is adapted to close during a first portion of a switching period, and open during a second portion of the switching period. The voltage reference generator also comprises a ripple monitor adapted to estimate a magnitude of variation of an output voltage of the voltage reference generator resulting from charging and discharging of the sampling capacitor, and based on the estimate, perform one of control of the sampling switch to reduce a switching frequency of the sampling switch to increase a magnitude of the variation of the output voltage, and control of the sampling switch to increase the switching frequency.

18 Claims, 4 Drawing Sheets

(56) References Cited

U.S. PATENT DOCUMENTS

| | | | | |
|---|---|---|---|---|
| 2004/0021506 | A1* | 2/2004 | Tanase | H03B 5/04 327/552 |
| 2008/0169866 | A1 | 7/2008 | Kleveland et al. | |
| 2009/0051331 | A1 | 2/2009 | Gerber et al. | |
| 2011/0032027 | A1 | 2/2011 | Dash et al. | |

OTHER PUBLICATIONS

Zhang et al., "A Nano-power Switched-capacitor Voltage Reference Using Body Effect in MOSFETs for Application in Subthreshold LSI", IEEE International Conference of Electron Devices and Solid-State Circuits (EDSSC), Jun. 3-5, 2013.

Zhang et al., "A Nano-power Switched-capacitor Voltage Reference Using MOS Body Effect for Applications in Subthreshold LSI", Journal of Semiconductor Technology and Science, vol. 14, Issue 1, pp. 70-82, Feb. 2014.

Chen et al., "A Wide Load Range and High Efficiency Switched-Capacitor DC-DC Converter With Pseudo-Clock Controlled Load-dependent Frequency", IEEE Transactions on Circuits and Systems-I: Regular Papers, vol. 61, Issue 3, pp. 911-921, Mar. 2014.

Extended European Search Report dated Jul. 27, 2017 for Application No. 17155631.9.

* cited by examiner

VOLTAGE REFERENCE GENERATOR AND A METHOD FOR CONTROLLING A MAGNITUDE OF A VARIATION OF AN OUTPUT VOLTAGE OF A VOLTAGE REFERENCE GENERATOR

CROSS-REFERENCE TO RELATED APPLICATIONS

This application claims priority to and the benefit of European Patent Application No. 17155631.9, filed on Feb. 10, 2017, the disclosure of which is incorporated herein by reference in its entirety.

TECHNICAL FIELD

The present inventive concept relates to a voltage reference generator, and to a method for controlling a magnitude of a variation of an output voltage of a voltage reference generator.

BACKGROUND

Modern circuity systems, for instance System on Chips (SoC), typically includes multiple power supplies for various purposes. Examples can be power supplies for digital core circuitry, memory circuitry, digital I/O circuitry and analog circuitry. Each of these power supplies may employ a voltage regulator, having as input a voltage reference. With the increasing attention to power dissipation, coming from the on-going miniaturization of electronic circuitries and devices, SoC design typically requires optimization of the power supplies of each particular circuitry block in order to reduce power consumption without affecting functionality. It is therefore typically advantageous to have different operating voltages for the digital core circuitry, memory circuitry, digital I/O circuitry and analog circuitry. Additionally, techniques such as Dynamic Voltage Scaling (DVS) is becoming increasingly interesting in this context as it allows to change the voltage supply depending on the needs. So, modern circuitry systems typically require the generation of multiple voltage references which also may be time-varying voltage references.

It is desirable that the generation of voltage references should be power efficient. Also considering that the voltage references may need to be active also during sleep modes, for instance for the purpose of enabling wake up of the system and maintaining relevant data in the memory. The power budget for generating voltage references may therefore be as small as few tens or hundreds of nA.

A prior art solution is to use switched-capacitor amplifiers. In this case, low power consumption can be achieved by choosing a very short switching period and by turning the amplifier off for the most of time, i.e. employing a small duty cycle.

SUMMARY

As realized by the inventor, a low switching frequency of a switched-capacitor amplifier results in the reference voltage becoming increasingly affected by the leakage of the switches. Also, leakage is strongly varying with fabrication process of the circuitry, as well as the ambient temperature during operation. This means that, to provide a low magnitude ripple on the output of each voltage reference under various operating and processing conditions, the switching frequency should be relatively high, which on the other hand leads to increased power consumption.

In view of this insight, an objective of the present inventive concept is to provide a voltage reference generator enabling limited leakage and improved power efficiency for circuitries manufactured under varying processing conditions and operating in different ambient conditions.

According to an aspect of the present inventive concept there is provided voltage reference generator comprising:

a voltage reference, a variable gain amplifier connected to an output terminal of the voltage reference, a sampling capacitor connected to an output terminal of the voltage reference generator and further connected to an output terminal of the variable gain amplifier via a sampling switch, said switch being adapted to alternate between a closed state and an open state, wherein the closed state spans a first portion of a switching period of said switch and the open state spans a second portion of the switching period, a ripple monitor adapted to estimate a magnitude of variation of an output voltage of the voltage reference generator resulting from the switch alternating between the closed state and the open state, and to, based on the estimate, perform one of:

control of the sampling switch to reduce a switching frequency of the sampling switch to increase a magnitude of the variation of the output voltage, and control of the sampling switch to increase the switching frequency, to decrease a magnitude of the variation of the output voltage.

The inventive voltage reference generator implements a feedback mechanism, wherein an estimated magnitude of the variation of the output voltage of the voltage reference generator is used as a basis for controlling the switching frequency of the sampling switch. Accordingly, the voltage reference generator may be controlled in an optimum manner with respect to leakage currents and power usage.

By voltage reference is hereby meant any circuitry adapted to output a reference voltage. The voltage reference preferably outputs a DC reference voltage which is constant. The voltage reference may advantageously be a band gap reference voltage circuit.

By variable gain amplifier is hereby meant any circuitry or circuit element adapted to amplify an input voltage and output the amplified input voltage. In particular the variable gain amplifier amplifies the output of the voltage reference. The variable gain amplifier may advantageously be a switched-capacitor amplifier. However, the variable gain amplifier may also be a resistive feedback amplifier.

By capacitor is hereby meant any circuit element or portion of a circuit being adapted to store a charge. The capacitor may include a pair of dedicated capacitor plates or sheets or may be formed by capacitively coupled circuit portions such as adjacent conducting paths of the voltage reference generator circuitry.

By ripple monitor is hereby meant any circuitry being adapted to estimate a magnitude of a variation of an output voltage of the voltage reference generator and to control the sampling switch to either reduce or increase the switching circuitry. The estimation may either be based on a "direct" measurement of the voltage of the sampling capacitor or of the output of the voltage reference generator; or by an "indirect" measurement, as will be further described below. The ripple monitor need not estimate an actual value of the magnitude but the magnitude estimate may involve the ripple monitor comparing a variation of a voltage to a threshold and estimate the magnitude by determining whether the variation exceeds, meets or falls below the threshold.

The threshold voltage may be a preset voltage of a level which limits the magnitude of the ripple of the output voltage to a level acceptable for the given implementation/application, while allowing the voltage reference generator to stay within the designed power budget. The setting of the threshold level hence typically requires that a trade-off between ripple/power consumption is made. Once the choice has been made for a given voltage reference generator, the ripple monitor and the controller may however enable the device to operate in a stable and optimum manner with respect to the threshold level.

In the following the variation of the output voltage may be referred to as the ripple of the output voltage (during one or more switching periods of the sample switch). Accordingly, the magnitude of the variation of the output voltage may be referred to as the magnitude of the ripple of the output voltage.

The ripple monitor may be adapted to output a first control signal for reducing a switching frequency of the sampling switch and to provide a second control signal for increasing the switching frequency. The first control signal and the second control signal may in a simple implementation be one of a high level signal (e.g. corresponding to a digital "1") and a low level signal (e.g. corresponding to a digital "0").

By switch is hereby meant any circuit element being able to act as a switch. That is, the switch may be changed between a closed state or "ON" state wherein a charge flow through the switch is allowed, and an open state or "OFF" state wherein a charge flow through the switch is prevented.

The first portion of the switching period may be referred to as the closed- or ON-portion and the second portion of the switching period may be referred to as the open- or OFF-portion of the switching period.

During the first portion of the switching period the capacitor may be charged, or discharged, by the amplifier. Whether charging or discharging occurs during the first portion may depend on whether a leakage current flows away from the capacitor or into the capacitor.

During the second portion of the switching period the capacitor may be discharged, or further charged. Whether discharging or further charging occurs during the second portion may depend on whether a leakage current flows away from the capacitor or into the capacitor.

By switching period is hereby meant the period in which a switch undergoes a cycle of closed-state and open-state. The switching frequency is the repetition frequency of the switching period.

The variable gain amplifier may be a switched-capacitor amplifier. The switching frequency of the sampling capacitor and the amplifier may be the same. The controller may be adapted to control the switched-capacitor amplifier to reduce a switching frequency of the switched-capacitor amplifier, e.g. in response to the estimated magnitude being lower than a threshold value, and to increase the switching frequency, e.g. in response to the estimated magnitude being greater than a threshold value.

The ripple monitor is adapted to estimate a magnitude or amplitude of the ripple of the output voltage. The ripple monitor may be adapted to determine a magnitude estimate which corresponds to the magnitude of the ripple of the output voltage.

According to one embodiment, the ripple monitor includes a monitor capacitor connected to the output terminal of the variable gain amplifier via a monitor switch, said monitor switch being adapted to close during a first portion of a switching period of the monitor switch, and the monitor switch being adapted to open during a second portion of the switching period wherein the monitor capacitor is discharged.

By this embodiment, a separate monitoring channel is provided which enables the ripple monitor to estimate the magnitude of the ripple of the output voltage of the voltage reference generator in an "indirect" manner.

The ripple of the output voltage may to a great extent be attributed to leakage currents of the sampling switch and the sampling capacitor. As realized by the inventor, a correlation between leakage current magnitudes for different portions of a circuit or chip can be assumed. Hence, the magnitude of the ripple of the output voltage of the monitor capacitor corresponds to the ripple of the output of the voltage reference generator.

The ripple monitor need hence not load the actual output of the voltage reference generator. The monitoring channel may furthermore be designed for the purpose of accurately estimating the magnitude to the ripple (e.g. via the capacitance of the monitor capacitor and by the switching frequency of the monitor switch), substantially without affecting the output of the voltage reference generator.

The monitor switch may be adapted to alternate between the closed state and the open state.

The ripple monitor may be adapted to compare a variation of a voltage of the monitor capacitor resulting from the monitor switch alternating between the closed state and the open state, to a reference and control the switching frequency of the monitor switch and the sampling switch based on a result of the comparison. This enables a relative precise and power efficient monitoring and control of the ripple using circuitry not directly loading the output of the voltage reference generator. Varying the switching frequency of both the monitor and the sampling switch allows the both the ripple of the output voltage of the voltage reference generator and the ripple of the voltage of the monitor capacitor to be controlled. The reference may be the output of the voltage reference, or a signal with a level corresponding to the output of the voltage reference.

The variation of the voltage of the monitor capacitor may be referred to as the ripple of the voltage of the monitor capacitor (during one or more switching periods of the monitor).

A capacitance of the monitor capacitor may be lower than a capacitance of the sampling capacitor. Accordingly, the sampling capacitor may be adapted to provide the desired output characteristics of the output of the voltage reference generator. Meanwhile, the monitor capacitor may be adapted to enable a more sensitive detection of the magnitude of the ripple. Additionally, a smaller capacitance enables a smaller wafer area to be used for the monitor capacitor.

Alternatively or additionally a switching frequency of the monitor switch of the ripple monitor may be lower than the switching frequency of the sampling switch. Accordingly, the switching frequency (or range of switching frequencies) of the sampling switch, and as the case may be the switching frequency of the switching capacitor amplifier, may be selected to provide the desired output characteristics of the voltage reference generator. Meanwhile, the switching frequency (or range of switching frequencies) of the monitor switch may be selected to enable a more sensitive detection of the magnitude of the ripple.

According to one embodiment the ripple monitor is adapted to compare a first voltage, based on a voltage of the monitor capacitor, to a second voltage, based on an output of the voltage reference, and to provide a comparison signal indicating a result of the comparison. The ripple monitor may control the switching frequency of the monitor switch and the sampling switch based on the comparison signal.

The ripple monitor may be adapted to, during a first switching period of the monitor switch, form the first voltage by adding a predetermined offset voltage to the voltage of the monitor capacitor, and control the switching frequency of the monitor switch and the sampling switch to increase in response to the comparison signal changing from a high level to a low level during the first switching period. Thereby, the ripple monitor may identify whether a current switching frequency of the monitor switch results in a leakage current from the monitor capacitor causing a voltage ripple magnitude exceeding the predetermined offset voltage, and control the switching frequency for reducing the magnitude of the voltage ripple.

The variable gain amplifier may be adapted to provide a unity gain during the first switching period.

The ripple monitor may be adapted to, during a second switching period subsequent to the first switching period, in response to the comparison signal remaining at the high level at expiry of the first switching period, form the first voltage by subtracting the predetermined offset voltage from the voltage of the monitor capacitor, and thereafter:

control the switching frequency of the monitor switch and the sampling switch to increase in response to the comparison signal changing from a low level to a high level during the second switching period, and control the switching frequency of the monitor switch and the sampling switch to decrease in response to the comparison signal remaining at a low level during the second switching period.

Thereby, the ripple monitor may identify whether the reason for the comparison signal not flipping from high to low in the first switching period is due to the leakage current flowing into, instead of out of, the monitor capacitor (indicated by the comparison signal remaining high at expiry of the second switching period) or due to the voltage ripple magnitude being smaller than the predetermined offset voltage (indicated by the comparison signal remaining at a low level during the switching period).

The variable gain amplifier may be adapted to provide a unity gain during the second switching period.

The first and the second switching periods may advantageously be consecutive switching periods. A speed of the control of the ripple voltage may thereby be improved.

The above-mentioned first switching period and/or the above-mentioned second switching period may form part of a ripple control period, during which the ripple monitor performs ripple control. The ripple monitor is adapted to estimate the magnitude of the voltage ripple and control the switching frequency during the ripple control period.

The variable gain amplifier may be adapted to provide a unity gain during the ripple control period.

The ripple monitor maybe adapted to, during a loading compensation phase spanning a set of switching periods of the monitor capacitor:

compare a first voltage, based on a voltage of the monitor capacitor, to a second voltage based on an output of the voltage reference, and provide a comparison signal indicating a result of the comparison, and iteratively increase or decrease the first voltage by a predetermined step size until the comparison signal has flipped between a high level and a low level, or vice versa, a predetermined number of times.

By performing loading compensation in such a manner, both loading effects (for instance caused by the monitor capacitor and the monitor switch) on the output of the voltage reference, as well as random offsets in the signal chain between the voltage reference output and the ripple monitor adapted to perform the comparison may be compensated for.

The ripple monitor may be adapted to perform loading compensation by:

comparing a first voltage, based on a voltage of the monitor capacitor, to a second voltage based on an output of the voltage reference, and provide a comparison signal indicating a result of the comparison, and iteratively varying the first voltage by a predetermined step size until the comparison signal has flipped between a high level and a low level, or vice versa, a predetermined number of times:

wherein, in response to the comparison signal (during a switching period) not flipping between a high level and a low level, or vice versa, the first voltage is increased by the predetermined step size, or wherein, in response to the comparison signal (during a switching period) flipping between a high level and a low level, or vice versa, the first voltage is decreased by the predetermined step size.

The ripple monitor may be adapted to perform loading compensation following each change of the switching frequency of the monitor switch and the sampling switch. Hence changes in the loading effect on the output of the voltage reference, due to the changed switching frequency of the monitor switch, may be compensated for.

The variable gain amplifier may be adapted to provide a unity gain during the loading compensation phase.

The variable gain amplifier may be adapted to provide an output signal with a unity gain to the monitor capacitor. This facilitates comparison with the voltage reference at the ripple monitor.

As an alternative to embodiments wherein a separate monitoring channel is provided, the ripple monitor may alternatively include a voltage sensing circuit connected to the output of the voltage reference generator and adapted to measure a magnitude of the ripple of the output voltage. According to a further alternative the ripple monitor may include a voltage sensing circuit connected to the sampling capacitor and adapted to measure a magnitude of the ripple of the voltage of the sampling capacitor. These alternative embodiments enable, what may be referred to, as a direct measurement or direct estimation of the magnitude of the ripple of the output voltage.

According to another aspect there is provided a method for controlling a magnitude of a variation of an output voltage of a voltage reference generator, the method comprising:

sampling, by a sampling capacitor connected to an output terminal of the voltage reference generator, an output of a variable gain amplifier at a first switching frequency, estimating a magnitude of a variation of an output voltage of the voltage reference generator (during one or more switching periods), and based on the estimated magnitude performing one of:

reducing the first switching frequency to increase a magnitude of the variation of the output voltage, and increasing the first switching frequency, to decrease a magnitude of the variation of the output voltage.

The advantages and details discussed in connection with the aforementioned voltage reference generator aspect applies correspondingly to the present method aspect. Reference is therefore made to the above discussion.

The variable gain amplifier may be connected to an output of a voltage reference.

According to one embodiment the method further comprises:

sampling, by a monitor capacitor, an output of the variable gain amplifier at a second switching frequency, estimating the magnitude of a variation of the output voltage of the voltage reference generator by comparing a variation of a voltage of the monitor capacitor to a reference (during one or more switching periods with respect to the monitor capacitor), and based on the comparison performing one of:

reducing the first switching frequency and the second switching frequency (to increase a magnitude of the variation of the output voltage and of the voltage of the monitor capacitor), and increasing the first switching frequency and the second switching frequency (to decrease a magnitude of the variation of the output voltage and of the voltage of the monitor capacitor).

Said act of comparing a (magnitude) of a variation of a voltage of the monitor capacitor to a reference may comprise comparing a first voltage, based on a voltage of the monitor capacitor, to a second voltage, based on an output of the voltage reference.

The method may further comprise, during a first switching period (with respect to the monitor capacitor), form the first voltage by adding a predetermined offset voltage to the voltage of the monitor capacitor, and increasing the first and the second switching frequency in response to a comparison signal, said comparison signal indicating a result of the comparison, changing from a high level to a low level during the first switching period.

The method may further comprise, during a second switching period subsequent to the first switching period, in response to the comparison signal remaining at the high level at expiry of the first switching period, form the first voltage by subtracting the predetermined offset voltage from the voltage of the monitor capacitor, and thereafter:

increasing the first and the second switching frequency in response to the comparison signal changing from a low level to a high level during the second switching period, and decreasing the first and the second switching frequency response to the comparison signal remaining at a low level during the second switching period.

The method may further comprise, during a loading compensation phase spanning a set of switching periods (with respect to the monitor capacitor):

comparing a first voltage, based on a voltage of the monitor capacitor, to a second voltage based on an output of a voltage reference, and provide a comparison signal indicating a result of the comparison, and iteratively increasing or decreasing the first voltage by a predetermined step size until the comparison signal has flipped between a high level and a low level, or vice versa, a predetermined number of times.

The method may further comprise performing loading compensation by:

comparing a first voltage, based on a voltage of the monitor capacitor, to a second voltage based on an output of the voltage reference, and provide a comparison signal indicating a result of the comparison, and iteratively varying the first voltage by a predetermined step size until the comparison signal has flipped between a high level and a low level, or vice versa, a predetermined number of times:

wherein, in response to the comparison signal (during a switching period) not flipping between a high level and a low level, or vice versa, the first voltage is increased by the predetermined step size, or wherein, in response to the comparison signal (during a switching period) flipping between a high level and a low level, or vice versa, the first voltage is decreased by the predetermined step size.

The method may comprise performing a loading compensation following each change of the first and the second switching frequency.

BRIEF DESCRIPTION OF THE DRAWINGS

The above, as well as additional objects, features and advantages of the present inventive concept, will be better understood through the following illustrative and non-limiting detailed description of preferred embodiments of the present inventive concept, with reference to the appended drawings. In the drawings like reference numerals will be used for like elements unless stated otherwise.

DETAILED DESCRIPTION

Detailed embodiments of the present inventive concept will now be described with reference to the drawings.

Figure 1:
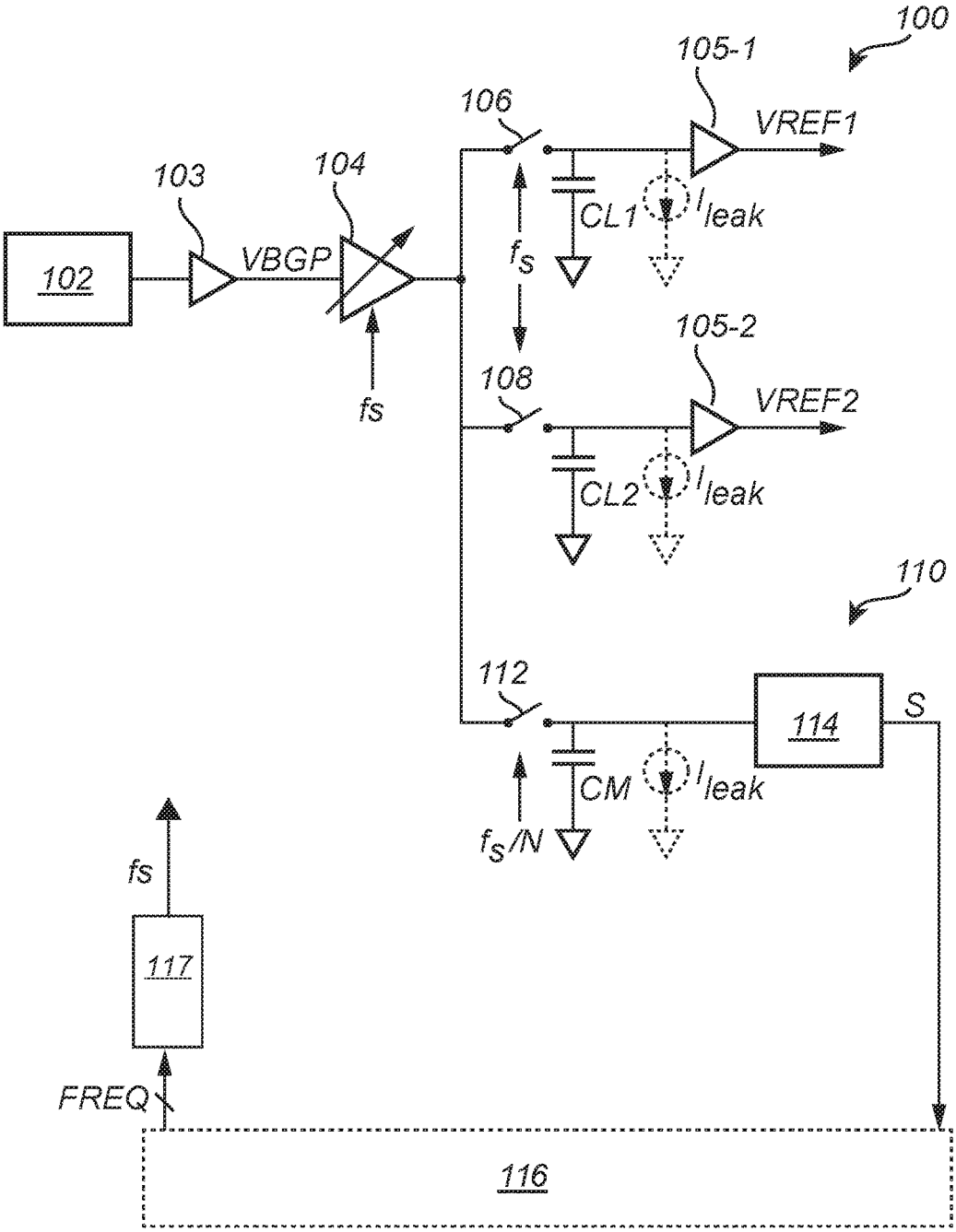
FIG. 1 is a schematic block diagram of a voltage reference generator.

FIG. 1 is a schematic block diagram of a voltage reference generator or voltage reference generator system 100. The voltage reference generator 100 is adapted to provide a respective voltage reference at each of the outputs VREF1, VREF2. The reference voltages output by the voltage reference generator 100 may be used as supply voltages for various circuits of a circuit system, such as an integrated circuit. A non-exhaustive list of examples includes supply voltages for digital core circuitry, memory circuitry, digital I/O circuitry and analog circuitry. The voltage reference generator 100 is shown with two outputs VREF1, VREF2. It is however equally possible to implement the following disclosure in a voltage reference generator 100 having only a single output, or more than two outputs. For simplicity, the labels VREF1 and VREF2 may in the following be used interchangeably to refer to both the respective output voltages and the output terminals through which the output voltages are provided.

The voltage reference generator 100 comprises a voltage reference 102. The voltage reference 102 may be a band gap reference voltage circuit, based for instance on bipolar junction transistors (BJTs) or metal oxide semiconductor field effect transistors (MOSFETs). The voltage reference 102 may be a low-voltage band gap reference voltage circuit outputting a constant predetermined voltage VBGP. The voltage may as a non-limiting example be in the range of a few tenths of volts to a few volts. The output of the voltage reference 102 forms the voltage based on which the one or more outputs VREF1, VREF2 of the voltage reference generator 100 are generated.

As shown a respective voltage buffer 105-1, 105-2 may be connected to the output terminals VREF1, VREF2. The voltage buffers 105-1, 105-2 may be unity gain buffers.

The voltage reference generator 100 comprises a variable gain amplifier 104 in the form of a switched-capacitor amplifier. It is however also possible to use other types of amplifiers having the ability to provide a variable gain output, such as a duty-cycled resistive feedback amplifier. The variable gain amplifier 104 is connected to an output terminal of the voltage reference 102. The variable gain amplifier 104 may as shown be connected to the output terminal of the voltage reference 102 via a voltage buffer 103. The voltage buffer 103 may be a unity gain buffer.

The voltage reference generator 100 includes a sampling switch 106 and a sampling capacitor CL1. A capacitance of the sampling capacitor CL1 may be on the order of a pF or a few hundreds of pF, as a non-limiting example. The sampling capacitor CL1 is connected to the output terminal VREF1 of the voltage reference generator 100 and further connected to an output terminal of the variable gain amplifier 104 via the sampling switch 106. The sampling switch 106 may be a conventional transistor-based switch, for instance a MOSFET or BJT.

In operation of the voltage reference generator 100, the sampling switch 106 is closed during a first portion of each switching period, wherein the capacitor samples the output of the variable gain amplifier 104. At the expiry of the first portion of each switching period the sampling switch 106 is opened and remains open during a second portion of the switching period corresponding to the remainder of the switching period. During the second portion of the switching period leakage currents will result in the capacitor being discharged or charged, depending on the direction of leakage currents. During each switching period, a voltage (or correspondingly a stored charge) of the capacitor will accordingly vary between a first voltage and a second higher or lower voltage. Viewed over the course of a sequence of consecutive switching periods, the output voltage VREF1 of the voltage reference generator 100 will accordingly vary. The variation forms a ripple in the output voltage VREF1.

In FIG. 1, the leakage paths are schematically represented by $I_{LEAK}$. A major portion of the leakage currents amounts to leakage via the sampling switch 106. The cycle of closing the switch and opening the switch is repeated in each switching period.

The duty cycle of the switching (i.e. the fraction of the switching period during which the sampling switch 106 is closed) may be set based on the amount of current the variable gain amplifier 104 is able to output for charging the sampling capacitor CL1, as well as on the capacitance of the capacitor.

The variable gain amplifier 104 may be operated at a same switching frequency as the sampling switch 106. At times where no charging of a capacitor is required (i.e. since the switches are open) the output of the variable gain amplifier 104 may be switched off, thereby preserving power. In other words, the output of the variable gain amplifier 104 need only be active while the sampling switch 106 is closed. If the variable gain amplifier 104 is implemented as a resistive feedback amplifier, power may similarly be preserved by switching the output of the amplifier off at times where no charging of a capacitor is required.

The circuit branch connected to the output terminal VREF2 of the voltage reference generator 100 includes a sampling switch 108 and a sampling capacitor CL2 having a structure and function corresponding to the switch 106 and the capacitor CL1. The sampling switches 106 and 108 may be switched in a synchronized manner with a same switching frequency.

The voltage reference generator 100 includes a ripple monitor 110. The ripple monitor is adapted to estimate a magnitude of the ripple of the output voltages VREF1, VREF2. The ripple monitor 110 of the illustrated voltage reference generator 100 includes a dedicated monitor channel, enabling what may be referred to as an indirect estimation of the magnitude of the ripple of the output voltages VREF1, VREF2. The estimation is indirect in the sense that no direct measurement of the ripple of the output voltages VREF1 and VREF2 is required.

As will be further described below, the ripple monitor 110, based on the estimated magnitude of the ripple, controls the sampling switch 106 to either reduce or increase a switching frequency of the sampling switch 106.

The ripple monitor 110 includes a monitor switch 112 and a monitor capacitor CM. The monitor capacitor CM is connected to the output terminal of the variable gain amplifier 104 via the monitor switch 112.

During operation, the monitor switch 112 undergoes a cycle of switching between a closed state and an open state. The monitor switch 112 is closed during a first portion of the cycle or switching period of the monitor switch 112. The monitor switch 112 is open during a second portion of the switching period of the monitor switch 112. When the monitor switch 112 is closed the monitor capacitor CM samples the output of the variable gain amplifier 104. When the monitor switch 112 is open the monitor capacitor CM may be discharged by the leakage currents (if flowing away from the monitor capacitor) or charged (if flowing into the monitor capacitor).

During operation, the monitor switch 112 is closed during the first portion of each switching period of the monitor switch 112. At the expiry of the first portion of each switching period the monitor switch 112 is opened and remains open during the second portion of the switching period, the second portion corresponding to the remainder of the switching period. During the second portion of the switching period of the monitor switch 112 leakage currents will result in the monitor capacitor CM being discharged or charged. During each switching period, a voltage (or correspondingly a stored charge) of the monitor capacitor CM will accordingly vary between a first voltage and a second higher or lower voltage. Viewed over the course of a sequence of consecutive switching periods, the voltage of the monitor capacitor CM will accordingly vary.

Similar to the output branches, the leakage paths of the monitor channel is in FIG. 1 schematically represented by $I_{LEAK}$. Although the leakage currents in the output branches and the monitor channel in practice need not be exactly equal, there will typically be a comparably high degree of correlation between the leakage currents, since the switches 106, 108 and 112, and the capacitors CL1, CL2 and CM typically are fabricated in the same processes and hence are subjected to the same processing conditions. Hence, the magnitude of the ripple of the voltage of the monitor capacitor CM will sufficiently correspond to the magnitude of the ripple of the output voltage(s) VREF1, VREF2, at least for the purposes of monitoring and controlling the magnitude of the ripple.

The capacitance of the monitor capacitor CM may be lower than a capacitance of the sampling capacitor CL1. The capacitance of the monitor capacitor CM may for instance be a fraction of the capacitance of the switching capacitor CL. By way of example the capacitance of the monitor capacitor CM may be one or a few tenths of the capacitance of the capacitance of the switching capacitor CL. Additional or alternatively, the switching frequency of the monitor switch 112 of the ripple monitor 110 may be lower than the switching frequency of the sampling switch 106, for instance a fraction 1/N of the switching frequency of the sampling switches 106, 108. Thereby even a comparably small ripple magnitude may be detected by the ripple monitor 110.

The ripple monitor 110 includes a comparison block 114 adapted to compare the time-varying voltage of the monitor capacitor CM to a reference and output a comparison signal S based on the comparison. The comparison block 114 may receive the output of the voltage reference 102 as an input. Alternatively, the reference signal may be any signal with a level corresponding to the output of the voltage reference 102.

The comparison block 114 may include circuitry for estimating a maximum difference between the reference and the voltage of the monitor capacitor CM. The maximum difference may be compared to a threshold. The comparison signal S output by the comparison block 114 may indicate whether the maximum difference exceeds the threshold or falls below the threshold.

The comparison signal S is received by a control block 116 of the ripple monitor 110. The control block 116 and the functions thereof may implemented in digital logic circuitry. The control block 116 outputs a control signal FREQ for setting the switching frequency of the variable gain amplifier 104, the sampling switches 106, 108 and the monitor switch 112. More specifically, the control block 116 may maintain a value of FREQ in a register. The control block 116 may increment FREQ by a predetermined amount in response to the comparison signal S indicating that the maximum difference between the reference and the voltage of the monitor capacitor CM exceeded the threshold. The control block 116 may decrease FREQ by the predetermined amount in response to the comparison signal S indicating that the maximum difference between the reference and the voltage of the monitor capacitor CM was less than the threshold.

The control signal FREQ may be converted to a switching signal for controlling the switching using a programmable oscillator 117. The programmable oscillator 117 may output a clock signal fs which is provided as an input signal to the variable gain amplifier 104 and the sampling switches 106, 108. The variable gain amplifier 104 may be turned on or activated at a rising edge of the clock signal, with a periodicity defined by the input FREQ. The programmable oscillator 117 may be turned off or inactivated when the capacitors (e.g. CL1, CL2, CM) have been charged, i.e. when the respective switches 106, 108, 112 have been opened. A reduced frequency switching signal fs/N for controlling the switching of the monitor switch 112 may be provided by feeding the output fs of the programmable oscillator 117 through a frequency divider.

Figure 2:
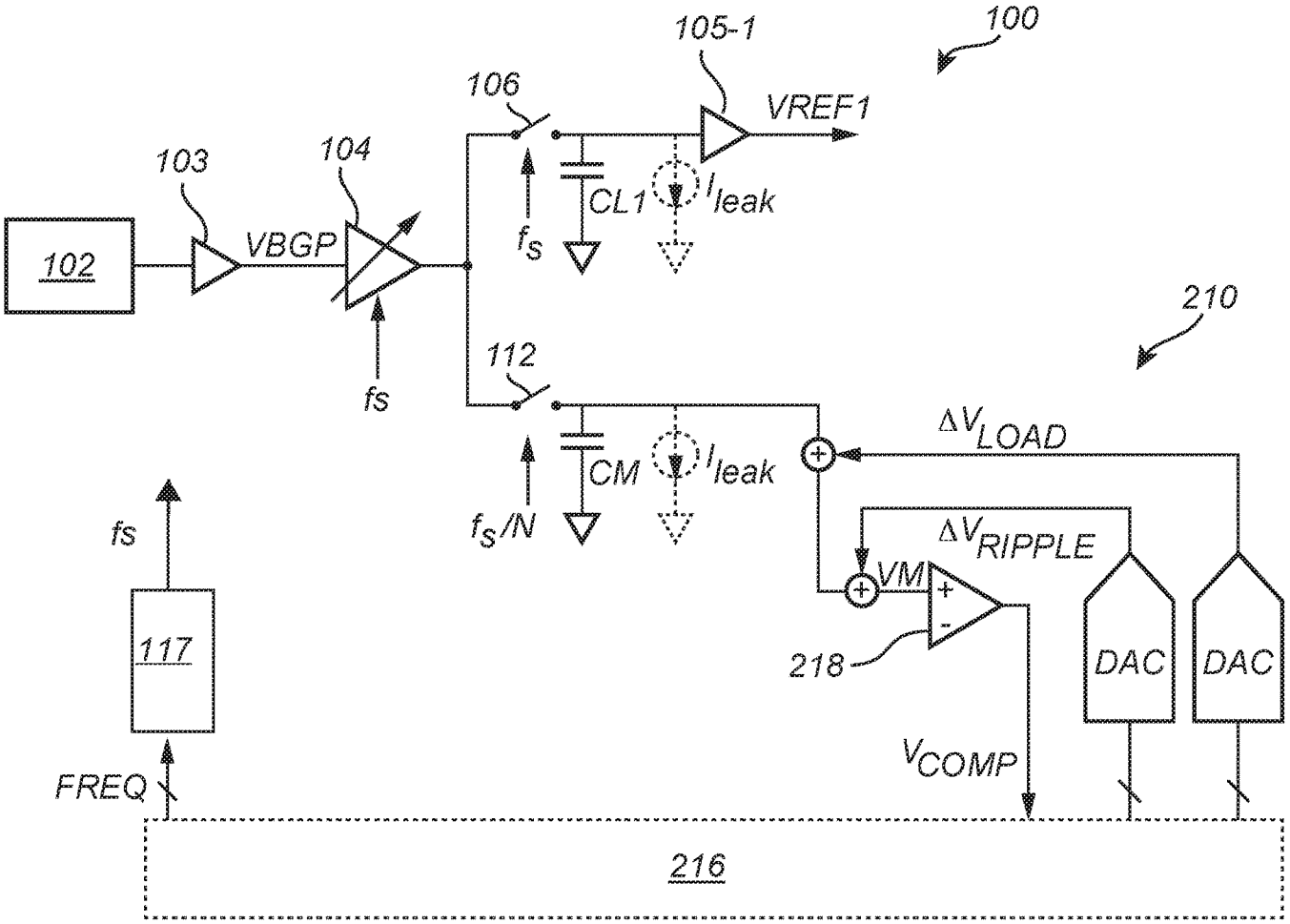
FIG. 2 is a schematic block diagram of a voltage reference generator.

FIG. 2 is a schematic block diagram of a voltage reference generator 100, similar to the voltage reference generator 100 shown in FIG. 1 but having a ripple monitor 210 of an alternative implementation. To facilitate understanding, only a single output VREF1 of the voltage reference generator 100 is shown.

The ripple monitor 210 includes a comparator 218. The comparator 218 has a first input terminal connected to the monitor capacitor CM. The comparator 218 has a second input terminal connected to the output terminal of the voltage reference 102. The comparator 218 outputs a digital comparison signal VCOMP indicating whether the voltage VM at the first input terminal is greater than the voltage at the second input terminal, or less than or equal to the voltage at the second input terminal.

The comparison signal VCOMP is received by a control block 216 of the ripple monitor 210. The control block 216 may similar to the control block 116 be implemented in digital logic circuitry. Depending on the mode of operation of the ripple monitor 210, the operation of the control block 216 responds differently to the comparison signal. The ripple monitor 210 is adapted to operate in one of a loading compensation mode and a ripple control mode. In the loading compensation phase the ripple monitor 210 operates in the loading compensation mode. In the ripple control phase the controller operates in the ripple control mode.

In the loading compensation mode, the ripple monitor 210 determines an offset voltage ΔVLOAD for shifting the voltage at the first input of the comparator 218 to correspond to (at least approximately) the output of the voltage reference 102. Thereby the voltage at the first input of the comparator may be shifted to vary about the tripping point of the comparator 218.

During the loading compensation phase, ΔVRIPPLE is zero. Initially in the loading compensation phase ΔVLOAD may be of a level corresponding to zero or ground. Alternatively ΔVLOAD may be of the level established during a previous loading compensation phase. ΔVLOAD and ΔVRIPPLE may as shown in FIG. 2 be provided by a respective digital-to-analog converter (DAC). The DACs are controlled by the control block 216.

In a first switching period of the loading compensation phase, the monitor switch 112 is closed wherein the monitor capacitor CM is charged (i.e. in the first portion of the switching period). Following opening of the monitor switch 112 (i.e. in the second portion of the switching period), the control block 216 determines based on VCOMP whether the voltage VM at the first input of the comparator crosses the output VBGP of the voltage reference 102. Provided ΔVLOAD is zero, VM will in the first switching period correspond to the voltage of the monitor capacitor CM. If VM does not cross VBGP, the control block 216 increases ΔVLOAD by a predetermined step size at the beginning of the next, second, switching period. If VM does cross VBGP, the control block 216 decreases ΔVLOAD by the predetermined step size. In the second switching period the monitor switch 112 is again closed wherein the monitor capacitor CM is charged. Following opening of the monitor switch 112, the control block 216 determines based on VCOMP whether the voltage VM at the first input of the comparator now crosses the output VBGP of the voltage reference 102. VM now corresponds to the voltage of the monitor capacitor CM increased or decreased by the present level of ΔVLOAD.

The evaluation of whether the voltage VM crosses the output VBGP may be implemented by the control block 216 monitoring the comparison signal VCOMP and determining whether VCOMP flips (i.e. changes from a digital high level to a digital low level or vice versa) during the switching period of the monitor switch 112.

The above process is iterated for a number of consecutive switching periods of the monitor capacitor CM. The control block 216 maintains a counter which is initialized to zero at the beginning of each loading compensation phase. The counter is incremented by one each time the comparison signal VCOMP flips.

In response to the counter reaching a predetermined integer N, the loading compensation mode is terminated, wherein the loading compensation phase is ended. The ripple monitor 210 may in response transition to the ripple control mode.

Figure 3:
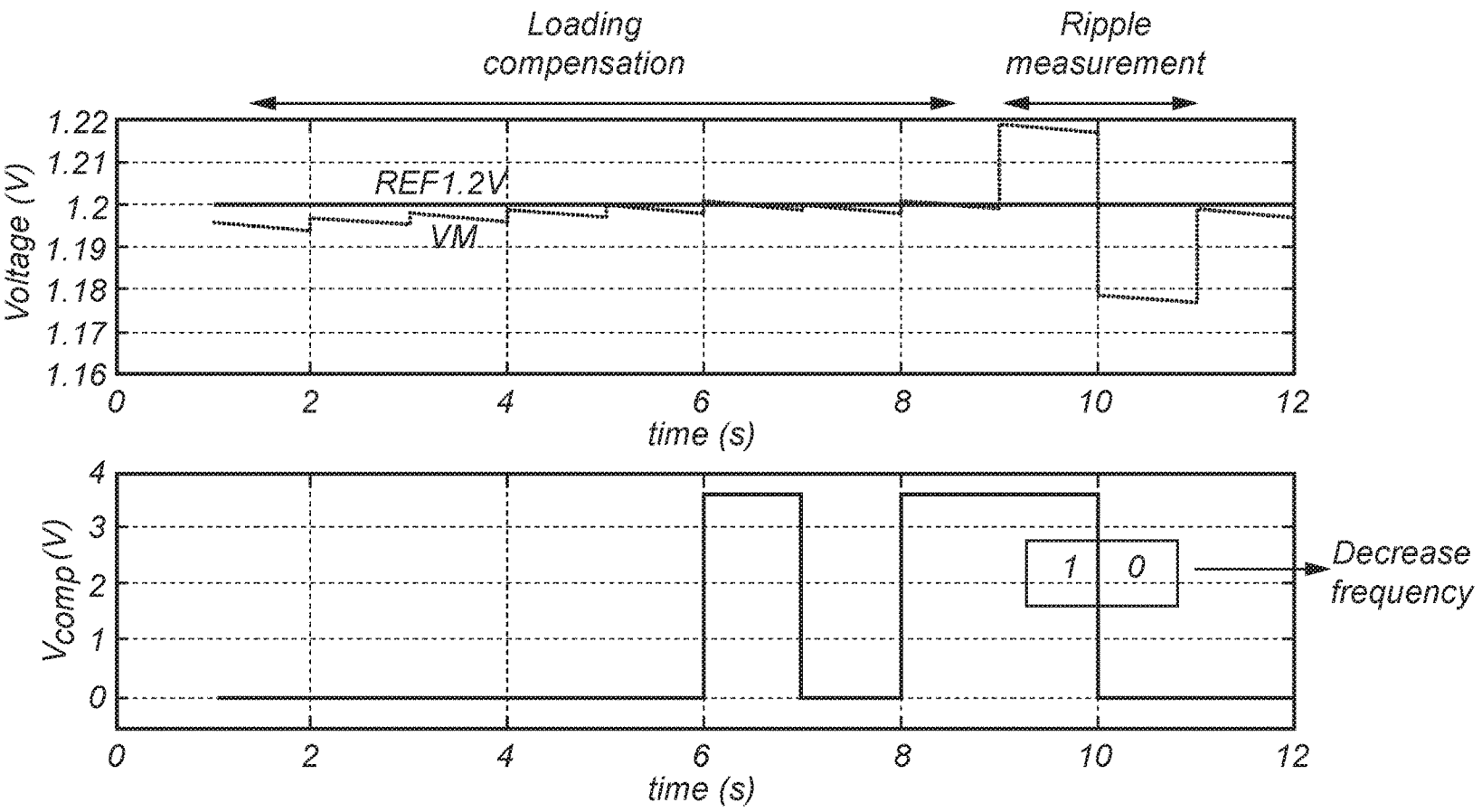
FIG. 3 shows example wave forms during a loading compensation period and a ripple monitor period.

FIG. 3 illustrates example wave forms of the voltage VM in relation to VBGP, and the resulting level of VCOMP during a loading compensation phase. In the example the loading compensation phase ends after VCOMP has flipped three times (i.e. N=3). As illustrated, the voltage VM presents a saw tooth-shaped ripple due to the repeated charging and discharging of the monitor capacitor CM.

In the ripple control phase the final level of ΔVLOAD established during the loading compensation phase is used for offsetting the voltage VM at the first input of the comparator 218.

During the switching periods of the ripple control phase, the monitor switch 112 repeats a closing-open cycle as described above wherein the monitor capacitor CM is repeatedly charged and discharged.

During a first switching period, ΔVRIPPLE is added to the voltage VM at the first input of the comparator. ΔVRIPPLE is a positive predetermined offset voltage set to correspond to the magnitude of the ripple deemed acceptable/optimum in the given application. More specifically, as will be further explained in the below, ΔVRIPPLE corresponds approximately to half of the optimum peak-to-peak amplitude of the ripple.

The controller monitors the comparison signal VCOMP. In response to VCOMP flipping from a digital high level to a digital low level during the first switching period, the controller outputs a control signal FREQ for increasing the switching frequency of the monitor switch 112 and the sampling switch 106. Thereby the magnitude of the ripple of the output voltage VREF1 as well as the voltage of the monitor capacitor CM may be decreased. The ripple control mode may thereafter be terminated. The ripple monitor 210 may in response transition to the loading compensation mode wherein a new loading compensation phase may commence.

If no flip of VCOMP is detected during the first switching period, the magnitude of the ripple may either have a magnitude which is smaller than desired, or have a peak-to-peak amplitude less than ±ΔVRIPPLE.

Accordingly in a next, second switching period of the ripple control phase ΔVRIPPLE is subtracted from the voltage VM at the first input of the comparator (i.e. by the DAC outputting −ΔVRIPPLE).

The controller monitors the comparison signal VCOMP. In response to VCOMP flipping from a digital low level to a digital high level during the second switching period, the controller outputs a control signal FREQ for increasing the switching frequency of the monitor switch 112 and the sampling switch 106. Thereby the magnitude of the ripple of the output voltage VREF1 as well as the voltage of the monitor capacitor CM may be decreased.

Alternatively, in response to VCOMP remaining at a low level at expiry of the second switching period, the controller outputs a control signal FREQ for increasing the switching frequency of the monitor switch 112 and the sampling switch 106. Thereby the magnitude of the ripple of the output voltage VREF1 as well as the voltage of the monitor capacitor CM may be decreased.

In either case, the ripple control mode may thereafter be terminated. The ripple monitor 210 may in response transition to the loading compensation mode wherein a new loading compensation phase may commence.

It is to be noted that the variable gain amplifier 104 may be controlled to provide a unity gain to the output signal which is sampled by the monitor capacitor CM.

FIG. 3 illustrates example wave forms of the voltage VM in relation to VBGP, and the resulting level of VCOMP during a ripple control phase. In the first switching period VM is increased by ΔVRIPPLE. VCOMP accordingly flips to a high digital level "1". The leakage current is however too small to cause flipping of VCOMP during the first switching period. In the second switching period VM is decreased by ΔVRIPPLE. VCOMP accordingly flips to a low digital level "0". As the leakage current discharges the monitor capacitor CM, VCOMP remains at the low level at the end of the second switching period. The control block 216 accordingly outputs a control signal for reducing the switching frequency of the monitor switch 112 and the sampling switch 106.

Figure 4:
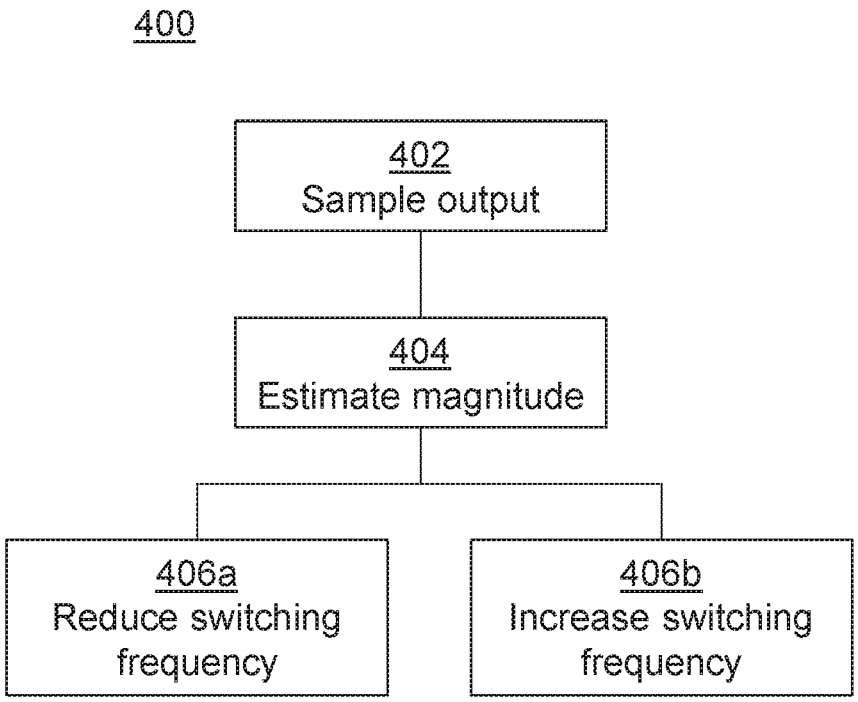
FIG. 4 is a flow chart for a method for controlling a magnitude of a variation of an output voltage of a voltage reference generator.

FIG. 4 illustrates a schematic flow chart of a method 400 for controlling a magnitude of a variation of an output voltage of the voltage reference generator 100.

The method comprises sampling, by the sampling capacitor 106 an output of the variable gain amplifier 104 at a first switching frequency (box 402).

The method further comprises the ripple monitor 110, 210 estimating a magnitude of a variation of an output voltage (e.g. VREF1) of the voltage reference generator 100 (box 404).

The method further comprises, based on the estimated magnitude performing one of: reducing the first switching frequency to increase a magnitude of the variation of the output voltage (box 406*a*); or increasing the first switching frequency, to decrease a magnitude of the variation of the output voltage (box 406*b*).

The magnitude of the variation of the output voltage of the voltage reference generator 100 may be estimated by directly measuring the voltage at the output of the voltage reference generator 100 (e.g. VREF1). Alternatively, the magnitude may be estimated in an indirect manner, as described above. I.e. the method may comprise sampling, by the monitor capacitor CM, an output of the variable gain amplifier at a second switching frequency (which may be different from the first switching frequency). A variation of a voltage of the monitor capacitor may be compared to the output of the voltage reference 102.

The method may further comprise, based on the comparison, performing one of: reducing the first switching frequency and the second switching frequency, or increasing the first switching frequency and the second switching frequency.

The comparison may include comparing, by the comparator 218, a first voltage VM, based on a voltage of the monitor capacitor CM, to a second voltage, based on an output of the voltage reference.

The method may comprise, during a first switching period, form the first voltage VM by adding a predetermined offset voltage ΔVRIPPLE to the voltage of the monitor capacitor, and increasing the first and the second switching frequency in response to a comparison signal VCOMP output by the comparator 218, indicating a result of the comparison, changing from a high level to a low level during the first switching period.

The method may further comprise, during a second switching period subsequent to the first switching period, in response to the comparison signal VCOMP remaining at the high level at expiry of the first switching period, form the first voltage by subtracting the predetermined offset voltage ΔVRIPPLE from the voltage of the monitor capacitor CM, and thereafter:

increasing the first and the second switching frequency in response to the comparison signal changing from a low level to a high level during the second switching period, or decreasing the first and the second switching frequency response to the comparison signal remaining at a low level during the second switching period.

The method may further comprise performing a loading compensation, in accordance with the loading compensation mode described above. The loading compensation may be performed following each change of the first and the second switching frequency.

In the above the inventive concept has mainly been described with reference to a limited number of examples. However, as is readily appreciated by a person skilled in the art, other examples than the ones disclosed above are equally possible within the scope of the inventive concept, as defined by the appended claims. For instance, as an alternative, the ripple monitor may alternatively include a voltage sensing circuit connected to the one or more outputs VREF1, VREF2 of the voltage reference generator and adapted to directly measure a magnitude of the ripple of the output voltage. The ripple may also be measured directly on the sampling capacitors (e.g. CL1, CL2) of the output branches of the voltage reference generator. The ripple control may be implemented in a manner corresponding to the above.

The invention claimed is:

1. A voltage reference generator comprising:

a voltage reference;

a variable gain amplifier connected to an output terminal of the voltage reference;

a sampling capacitor connected to an output terminal of the voltage reference generator and further connected to an output terminal of the variable gain amplifier via a sampling switch of the voltage reference generator, said sampling switch being adapted to alternate between a closed state and an open state, wherein the closed state spans a first portion of a switching period of said sampling switch, and the open state spans a second portion of the switching period; and a ripple monitor adapted to estimate a magnitude of a variation of an output voltage of the voltage reference generator resulting from the sampling switch alternating between the closed state and the open state, and to, based on the estimate, perform one of:

control of the sampling switch to reduce a switching frequency of the sampling switch to increase the magnitude of the variation of the output voltage, and control of the sampling switch to increase the switching frequency, to decrease a the magnitude of the variation of the output voltage, wherein the ripple monitor includes a monitor capacitor connected to the output terminal of the variable gain amplifier via a monitor switch, said monitor switch being adapted to close during a first portion of a switching period of the monitor switch, and the monitor switch being adapted to open during a second portion of the switching period.

2. The voltage reference generator according to claim 1, wherein the ripple monitor is adapted to compare a variation of a voltage of the monitor capacitor resulting from the monitor switch alternating between the closed state and the open state, to a reference and control the switching frequency of the monitor switch and the sampling switch based on a result of the comparison.

3. The voltage reference generator according to claim 1, wherein a capacitance of the monitor capacitor is lower than a capacitance of the sampling capacitor.

4. The voltage reference generator according to claim 1, wherein a switching frequency of the monitor switch of the ripple monitor is lower than the switching frequency of the sampling switch.

5. The voltage reference generator according to claim 1, wherein the ripple monitor is further adapted to compare a first voltage, based on a voltage of the monitor capacitor, to a second voltage, based on an output of the voltage reference, and to provide a comparison signal indicating a result of the comparison.

6. The voltage reference generator according to claim 5, wherein the ripple monitor is adapted to, during a first switching period of the monitor switch, form the first voltage by adding a predetermined offset voltage to the voltage of the monitor capacitor, and control the switching frequency of the monitor switch and the sampling switch to increase in response to the comparison signal changing from a high level to a low level during the first switching period.

7. The voltage reference generator according to claim 6, wherein the ripple monitor is adapted to, during a second switching period subsequent to the first switching period, in response to the comparison signal remaining at the high level at expiry of the first switching period, form the first voltage by subtracting the predetermined offset voltage from the voltage of the monitor capacitor, and thereafter:

control the switching frequency of the monitor switch and the sampling switch to increase in response to the comparison signal changing from a low level to a high level during the second switching period, and control the switching frequency of the monitor switch and the sampling switch to decrease in response to the comparison signal remaining at a low level during the second switching period.

8. The voltage reference generator according to claim 1, wherein the ripple monitor, during a loading compensation phase spanning a set of switching periods for the monitor capacitor, is adapted to:

compare a first voltage, based on a voltage of the monitor capacitor, to a second voltage based on an output of the voltage reference, and provide a comparison signal indicating a result of the comparison, and iteratively increase or decrease the first voltage by a predetermined step size until the comparison signal has flipped between a high level and a low level, or vice versa, a predetermined number of times, wherein, in response to the comparison signal not flipping between a high level and a low level, or vice versa, the first voltage is increased by the predetermined step size, and wherein, in response to the comparison signal flipping between a high level and a low level, or vice versa, the first voltage is decreased by the predetermined step size.

9. The voltage reference generator according to claim 8, wherein the ripple monitor is adapted to perform a loading compensation following each change of the switching frequency of the monitor switch and the sampling switch.

10. The voltage reference generator according to claim 6, wherein the variable gain amplifier is adapted to provide an output signal with a unity gain to the monitor capacitor.

11. An integrated circuit including the voltage reference generator according to claim 1.

12. A System on Chip, SoC, including the voltage reference generator according to claim 1.

13. A method for controlling a magnitude of a variation of an output voltage of a voltage reference generator, the method comprising:

sampling, by a sampling capacitor connected to an output terminal of the voltage reference generator via a sampling switch, an output of a variable gain amplifier at a first switching frequency, sampling, by a monitor capacitor connected to the output terminal of the variable gain amplifier via a monitor switch, an output of the variable gain amplifier at a second switching frequency, estimating the magnitude of a variation of an output voltage of the voltage reference generator by comparing a variation of a voltage of the monitor capacitor to a reference voltage, and based on the comparison performing one of:

reducing the first switching frequency to increase the magnitude of the variation of the output voltage, and reducing the second switching frequency, increasing the first switching frequency, to decrease the magnitude of the variation of the output voltage, and increasing the second switching frequency.

14. The method according to claim 13, wherein said act of comparing a variation of a voltage of the monitor capacitor to a reference comprises comparing a first voltage, based on a voltage of the monitor capacitor, to a second voltage, based on an output of the voltage reference.

15. The method according to claim 14, further comprising, during a first switching period, form the first voltage by adding a predetermined offset voltage to the voltage of the monitor capacitor, and increasing the first and the second switching frequency in response to a comparison signal, said comparison signal indicating a result of the comparison, changing from a high level to a low level during the first switching period.

16. The method according to claim 15, further comprising:

during a second switching period subsequent to the first switching period, in response to the comparison signal remaining at the high level at expiry of the first switching period, forming the first voltage by subtracting the predetermined offset voltage from the voltage of the monitor capacitor, and thereafter:

increasing the first and the second switching frequency in response to the comparison signal changing from a low level to a high level during the second switching period, and decreasing the first and the second switching frequency in response to the comparison signal remaining at a low level during the second switching period.

17. The method according to claim 13, further comprising, performing loading compensation by:

comparing a first voltage, based on a voltage of the monitor capacitor, to a second voltage based on an output of the voltage reference, and provide a comparison signal indicating a result of the comparison, and iteratively varying the first voltage by a predetermined step size until the comparison signal has flipped between a high level and a low level, or vice versa, a predetermined number of times:

wherein, in response to the comparison signal not flipping between a high level and a low level, or vice versa, the first voltage is increased by the predetermined step size, wherein, in response to the comparison signal flipping between a high level and a low level, or vice versa, the first voltage is decreased by the predetermined step size.

18. The method according to claim 17, further comprising performing a loading compensation following each change of the first and the second switching frequency.

* * * * *